US011841117B1

(12) United States Patent
Beckhart

(10) Patent No.: US 11,841,117 B1
(45) Date of Patent: Dec. 12, 2023

(54) ENCAPSULATED STICK-ON WINDOW LIGHT

(71) Applicant: Gordon Haggott Beckhart, Colorado Springs, CO (US)

(72) Inventor: Gordon Haggott Beckhart, Colorado Springs, CO (US)

( * ) Notice: Subject to any disclaimer, the term of this patent is extended or adjusted under 35 U.S.C. 154(b) by 0 days.

(21) Appl. No.: 18/094,907

(22) Filed: Jan. 9, 2023

Related U.S. Application Data

(60) Provisional application No. 63/298,599, filed on Jan. 11, 2022.

(51) Int. Cl.

| | |
|---|---|
| ***F21V 21/08*** | (2006.01) |
| ***F21S 9/03*** | (2006.01) |
| ***F21Y 115/10*** | (2016.01) |
| ***F21S 8/00*** | (2006.01) |

(52) U.S. Cl.
CPC ..... *F21S 8/033* (2013.01); *F21S 9/037* (2013.01); *F21V 21/08* (2013.01); *F21Y 2115/10* (2016.08)

(58) Field of Classification Search
CPC ..... F21V 21/0808; F21V 21/092; F21V 21/0925; F21S 8/033; F21S 21/08
See application file for complete search history.

(56) References Cited

U.S. PATENT DOCUMENTS

| | | | | |
|---|---|---|---|---|
| 5,618,100 | A | 4/1997 | Glynn | |
| 7,065,910 | B2 | 6/2006 | Woodruff | |
| 7,360,918 | B2 | 4/2008 | Trombetta et al. | |
| 7,887,214 | B2 | 2/2011 | Chang et al. | |
| 7,972,048 | B1 | 7/2011 | Lamborn | |
| 8,317,352 | B2 | 11/2012 | Saccomanno | |
| 10,386,029 | B1 | 8/2019 | Laydera-Collins | |
| 10,663,123 | B2 | 5/2020 | Plavnicky | |
| 2012/0147612 | A1 | 6/2012 | Verhoeven et al. | |
| 2013/0161460 | A1 | 6/2013 | Switky et al. | |
| 2018/0259175 | A1 * | 9/2018 | Welfare | F21V 21/092 |

FOREIGN PATENT DOCUMENTS

| | | | | |
|---|---|---|---|---|
| WO | WO-2012170609 | A2 * | 12/2012 | F21S 9/037 |
| WO | 2017/028290 | A1 | 2/2017 | |

* cited by examiner

*Primary Examiner* — Karabi Guharay
(74) *Attorney, Agent, or Firm* — The Law Office of Patrick F. O'Reilly III, LLC

(57) ABSTRACT

An encapsulated stick-on window light is disclosed herein. The encapsulated stick-on window light includes at least one light emitting device configured to emit light; and an encapsulating body, the encapsulating body surrounding the at least one light emitting device such that the at least one light emitting device is totally enclosed within the encapsulating body, the encapsulating body having at least one surface that is configured to adhere to a glass surface by means of electrostatic forces and/or Van der Waals forces.

15 Claims, 9 Drawing Sheets

ENCAPSULATED STICK-ON WINDOW LIGHT

CROSS-REFERENCE TO RELATED APPLICATIONS

This patent application claims priority to, and incorporates by reference in its entirety, U.S. Provisional Patent Application No. 63/298,599 entitled "Encapsulated Stick-On Window Light", filed on Jan. 11, 2022.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to an encapsulated stick-on window light. More particularly, the invention relates to an encapsulated stick-on window light that is configured to adhere to a glass surface by means of electrostatic forces and/or Van der Waals forces.

2. Background

Window lights and lighted holiday decorations are a long-standing tradition. Since the days when the only light available was a candle or other flame, candles have been placed in windows. In colonial times a lit candle in the window signified good news or a friendly welcome, and this lit candle has since become a holiday tradition. The worm glow of a burning candle was the only light source for centuries. Over the last century this window lighting tradition has persisted and evolved a little bit with more modern and safer plug-in lights and then later with battery-operated candles.

The battery and plug-in candles often look exactly like their wax and flame predecessors. The plastic molded body of the candle will even have molded in the effect of dripping wax. These lights are still designed to sit on the sill ledge of a traditional window.

Although these newer holiday electric candles are safer and more reliable than a flame, there are some issues that can be improved. Plugging in a cord is often not an option near some windows. Battery operated candles solve this issue but still require a sill to sit on. Replacing batteries or batteries going bad after a year of storage is an issue. These candles are still a few inches wide and do not fit in windows with tight blinds or shades that come close to the window. They also will not work with more modern windows that may not have a large enough sill. And they do not work well for larger floor to ceiling windows since the lights would be sitting on the floor.

What is needed is an innovative lighting system that allows for decorating window glass with thin lights that stick to glass in any location on a glass window pane. A thin light can fit on windows even in situations with tight window blinds or shutters. A thin light that can be placed above a sill or floor level can be used at eye level or any location on a floor to ceiling window. A thin light that adheres to the glass surface opens a wide range of decorative options, while still honoring the tradition of signifying a friendly welcome or holiday cheer of a lighted window. A thin encapsulated light that can easily attach anywhere on a glass surface, can easily be removed, can compactly store away, and can easily rinse clean for reuse the next holiday, would open up a world of possibilities.

BRIEF SUMMARY OF EMBODIMENTS OF THE INVENTION

Accordingly, the present invention is directed to an encapsulated stick-on window light that substantially obviates one or more problems resulting from the limitations and deficiencies of the related art.

In accordance with one or more embodiments of the present invention, there is provided an encapsulated stick-on window light that includes at least one light emitting device configured to emit light; and an encapsulating body, the encapsulating body surrounding the at least one light emitting device such that the at least one light emitting device is totally enclosed within the encapsulating body, the encapsulating body having at least one surface that is configured to adhere to a glass surface by means of electrostatic forces and/or Van der Waals forces.

In a further embodiment of the present invention, the encapsulated stick-on window light further comprises a power source disposed in the encapsulating body, the power source configured to provide power for the at least one light emitting device.

In yet a further embodiment, the power source disposed in the encapsulating body comprises one or more batteries configured to provide power for the at least one light emitting device.

In still a further embodiment, the one or more batteries are provided in a battery compartment within the encapsulating body, the battery compartment being provided with a removable compartment door that is accessible from outside of the encapsulating body.

In yet a further embodiment, the one or more batteries are not accessible from outside of the encapsulating body.

In still a further embodiment, the power source disposed inside the encapsulating body further comprises one or more solar cells configured to provide power for the at least one light emitting device, an active surface of the one or more solar cells being disposed proximate to the at least one surface of the encapsulating body so that light is able to be absorbed by the active surface of the one or more solar cells.

In yet a further embodiment, the encapsulated stick-on window light further comprises a control board disposed in the encapsulating body, the control board configured to control solar energy collection and storage by the one or more solar cells and the one or more batteries.

In still a further embodiment, the control board is configured to charge the one or more batteries when light is available to the one or more solar cells, and then switch power to illuminate the at least one light emitting device when solar charging falls below a preset level indicating dark outside conditions.

In yet a further embodiment, the encapsulated stick-on window light further comprises one or more electrical wires disposed in the encapsulating body, the one or more electrical wires electrically coupling the at least one light emitting device to the control board and/or the power source.

In still a further embodiment, the encapsulated stick-on window light further comprises a power port accessible from a side of the encapsulating body, the power port operatively coupled to the at least one light emitting device, the power port configured to accommodate an external power cord for providing power to the at least one light emitting device from an external power source that is external to the encapsulating body.

In yet a further embodiment, the at least one light emitting device is in a form of one or more one or more light-emitting diodes (LEDs).

In still a further embodiment, the at least one light emitting device is in a form of a microdisplay, the microdisplay configured to display alphanumeric signage, static images, and/or dynamic images.

In yet a further embodiment, the encapsulated stick-on window light further comprises a data port accessible from a side of the encapsulating body, the data port operatively coupled to the microdisplay, and the data port configured to enable a programming and/or reprogramming of the microdisplay.

In still a further embodiment, the encapsulating body allows the stick-on window light to be cleaned and rinsed with water without harming any electrical components of the stick-on window light.

In yet a further embodiment, the encapsulating body is formed from a material selected from a group consisting of: (i) silicone, (ii) a two-part room temperature vulcanization (RTV) material, (iii) compression molded rubber, (iv) pourable setting rubber, (v) thermoset rubber, and (vi) any other encapsulating material that exhibits electrostatic and/or Van der Waals attraction with glass.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
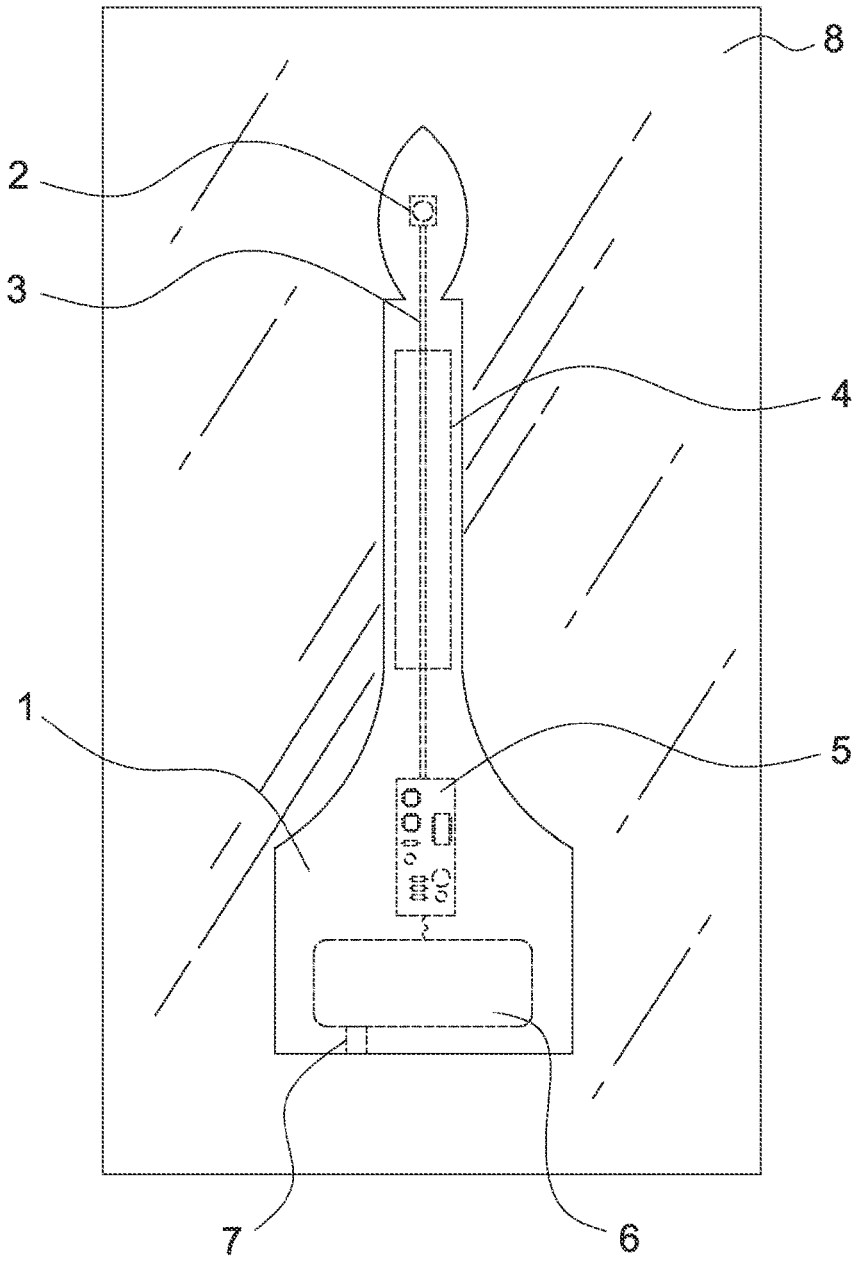
FIG. 1 is a top view of a light in the shape of a candlestick, according to an example embodiment of the invention.

What is described herein is a novel fully encapsulated light or lights designed to stick anywhere on a glass surface without suction cups or any type of adhesive. The rubber or silicone encapsulating body of the light sticks on the glass with electrostatic or Van der Waals forces. These novel window lights can be placed anywhere on a glass surface and in any orientation. These lights can include holiday lights, house marker lights, indicator lights to help a delivery service identify the house, welcome friends to a party, indicate that a store is open or closed, or other indicator or decorative lights that may be placed in a window.

In one version of this light everything is self-contained within a silicone body. Simply pressing this to a window where it immediately sticks, will provide a holiday decoration. This light includes a solar cell or solar cells designed to be facing out the window to collect light. Within the body of this self-contained light is a circuit board to control solar energy collection to a battery, and control the light on/off condition of an LED light. The battery can be permanently contained or contained behind a battery door to allow for a replaceable battery. The body of the light can also include a USB or other receptacle to recharge or add additional charge to a battery, or to reprogram a circuit board.

In one or more embodiments, the light is fully encapsulated to make it more rugged and protect the fragile components from general use and long-term storage in the case of holiday decorations. The full encapsulation importantly allows a simple rinse to remove dust or other contaminants off the flat rubber surface to provide the strongest electrostatic adhesion to a glass surface. This is not a fragile or flimsy film layer that would not provide protection from even the simple handling and storage of a holiday light. In these one or more embodiments, this is a rubber or silicone body thick enough to fully encapsulate any components including a solar cell or solar cells, battery, circuit board, wiring, or other components.

This is a light that is so simple to use, it only requires placement on a window to stick and start its operation. This does not rely on a suction cup or suction cups. This does not rely on any type of tape or adhesive components. This does not have a thin film. The entire encapsulated body of the light sticks to a glass surface in any location and in any orientation. This light does not require a window sill or any other type of ledge to sit on or hang from.

Another lower cost version of the fully encapsulated light can have just the illumination source such as an LED in the encapsulating body. This would lower the cost of each individual window adhering light element. These individual encapsulated light sources can be connected to a simple power source or lighting controller. They can be linked together in parallel or in series to make a scene such as snowflakes over a window, or a string of lights on the inside edge of a window.

The optional placement on a window, in any orientation, with little limitation on size, shape, and color opens up a wide range of creative options for this novel light. These can be formed in the classic traditional shape and colors of a lighted candle, holiday wreath, fall pumpkin, or other holiday theme lighting. The low power LEDs or other lighting sources can be any color available, and the body of the light can have one or more illuminated sources. Fully encapsulating a light source within a body that sticks to glass with electrostatic or Van der Waals forces opens up a wide range of possibilities and variations.

In one or more example embodiments, a fully encapsulated light source is disclosed that easily sticks to window glass in any location and in any orientation using electrostatic or Van Der Waals forces. The encapsulating body can be silicone or another flexible insulating material that can stick to glass on its own. The encapsulated body of this light fixture should weigh less than 0.75 ounces per square inch of surface area available to stick on the glass surface. The encapsulating body includes at least one light or illumination source. The encapsulating body can include everything needed to generate power and control power to the light source including a solar cell, battery, and circuit board. The encapsulated light source can also be just the illumination source that is connected to an outside power supply. These independent encapsulated lights can also be connected together in series or in parallel with other lights.

In accordance with the devices of the present application, a light (herein referred to as "light") may include, but is not limited to the assembly of a rubber encapsulating body with at least one LED, or a rubber encapsulating body with an LED and any combination of a solar cell or cells, battery, circuit board, connecting wires, and a port.

In accordance with the devices of the present application, an LED (herein referred to as "LED") may include, but is not limited to LED light, LED lights, a micro display, micro displays, an incandescent light, or other light emitting sources.

In accordance with the devices of the present application, a rubber material (herein referred to as "rubber") may include but is not limited to a silicone, 2-part room temperature vulcanization (RTV), compression molded rubber, pourable setting rubber, thermoset rubber, or any encapsulating material that exhibits electrostatic or Van der Waals attraction with glass.

In accordance with the devices of the present application, a solar cell (herein referred to as "solar cell") may include but is not limited to multiple solar cells, photovoltaic cell or cells, solar module or modules, any device that converts light into electricity, or any device that acts as a photodetector.

In accordance with the devices of the present application, to stick on (herein referred to as "stick on") may include but is not limited to press on, place on, slap on, adhere, or any action that puts the flat surface of the body in contact with glass to allow an electrostatic or Van der Waals bonding.

In accordance with the devices of the present application, a port (herein referred to as "port") may include but is not limited to a USB plug, charging port, programming port, data port, male or female plug, or any means of electrically connecting to the light fixture.

In accordance with the devices of the present application, a battery (herein referred to as "battery") may include but is not limited to any device capable of storing electrical energy.

FIG. 1 is a top view of a light in the shape of a candlestick. The light has a full rubber encapsulating body 1, LED light 2, internal connecting wires 3, circuit board 5, battery 6, port 7, and solar cells 4. The encapsulating body 1 is sticking to glass 8.

Figure 2:
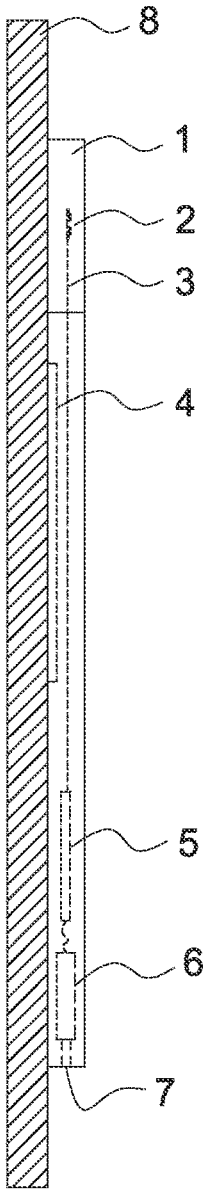
FIG. 2 is a side view of the light in the shape of the candlestick of FIG. 1.

FIG. 2 is a side view of a light in the shape of a candlestick. The rubber body 1 is sticking on glass 8 with electrostatic or Van der Waals forces. Inside the body 1 is an LED 2, connecting wires 3, circuit board 5, battery 6, and port 7. Solar cells 4 are facing toward the window to collect solar energy from the outside. Circuit board 5 and battery 6 work together with solar cells 4 to collect electricity and store it. Wires 3 connect all the devices. Port 7 allows additional charging and/or programming of the circuit board.

In the example embodiment shown in FIGS. 1 and 2, Van der Waal forces or electrostatic interaction hold a light to a glass window 8. In this example embodiment the weight of the light needs to be at or below 0.75 ounces per square inch of light body 1 surface area touching glass 8 to provide best holding forces. In this example embodiment the thickness of the silicone is kept to the minimum needed to fully encapsulate the solar cells 4, LED 2, battery 6, circuit board 5, connecting wires 3, and port 7. In this example embodiment, the components are fully encapsulated so that the light can be safely rinsed off to create a clean surface that provides the best electrostatic and Van der Walls forces for adhesion to glass. Also, because the components are fully encapsulated by the rubber body 1, no additional housing is needed for the device.

In the example embodiment shown in FIGS. 1 and 2, the light is formed in the shape of a candle on a candle stick. In this example embodiment the candle flame is simulated by an LED 2 light. In one example embodiment the LED 2 can have a flickering effect to further simulate a flame. In this example embodiment there is a solar cell 4 that is facing out when placed on a window. In this example embodiment the battery 6 is charged when light is available to the solar cell 4, and the power is switched to illuminate the LED 2 when the solar charging falls below a preset level indicating that it is dark outside.

Figure 3:
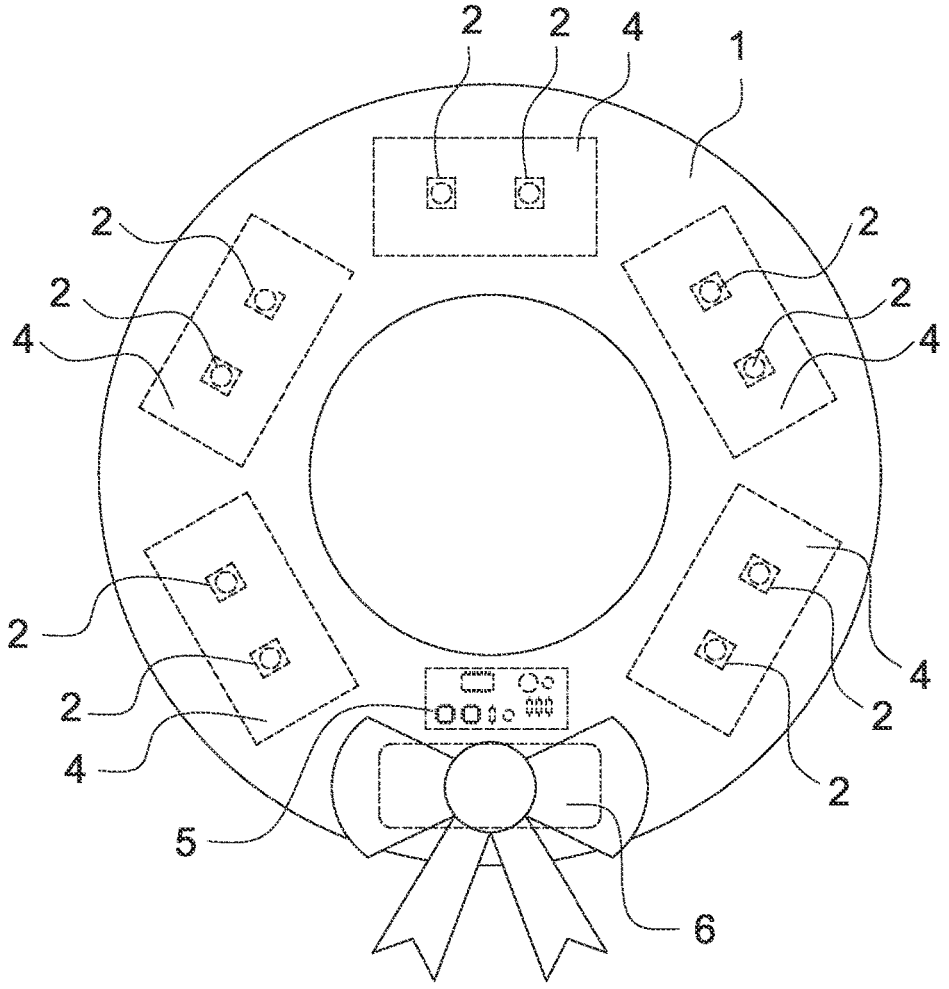
FIG. 3 is a top view of a light with an encapsulating body in the shape of a wreath, according to another example embodiment of the invention.

FIG. 3 is a top view of a light with the encapsulating rubber body 1 in the circular shape of a wreath. Inside the body 1 are LED's 2, solar cells 4, circuit board 5, and battery 6.

Figure 4:
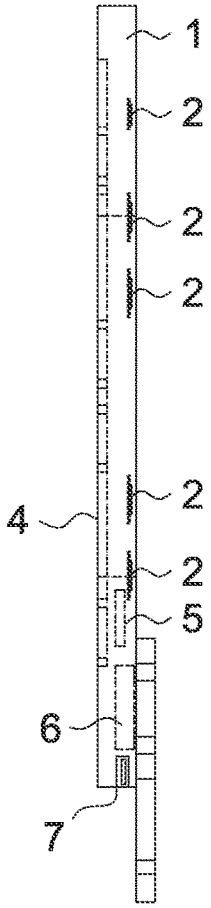
FIG. 4 is a side view of the light with the encapsulating body in the shape of the wreath of FIG. 3.

FIG. 4 is a side view of a light with encapsulating rubber body 1 in the circular shape of a wreath. Inside the body 1 are LED's 2, solar cells 4, circuit board 5, battery 6, and port 7.

In the example embodiment shown in FIGS. 3 and 4, the light is formed in the shape of a wreath. In this example embodiment, there are multiple LED lights 2 and multiple solar cells 4 distributed around the encapsulated body 1.

In another example embodiment the light may be shaped and colored in the form of any holiday decoration maintaining a generally flat thickness.

In an example embodiment the solar cell or solar cells are just below the surface of the rubber. In this example embodiment the solar cells are covered with a thin layer of surface rubber and can still collect light. In this embodiment the rubber surface is maximized to provide the maximum surface for electrostatic or Van der Walls forces of attraction.

In another example embodiment, the light may be formed in the shape of numerals and letters and can be used in combination to create an illuminated address or message.

Figure 5:
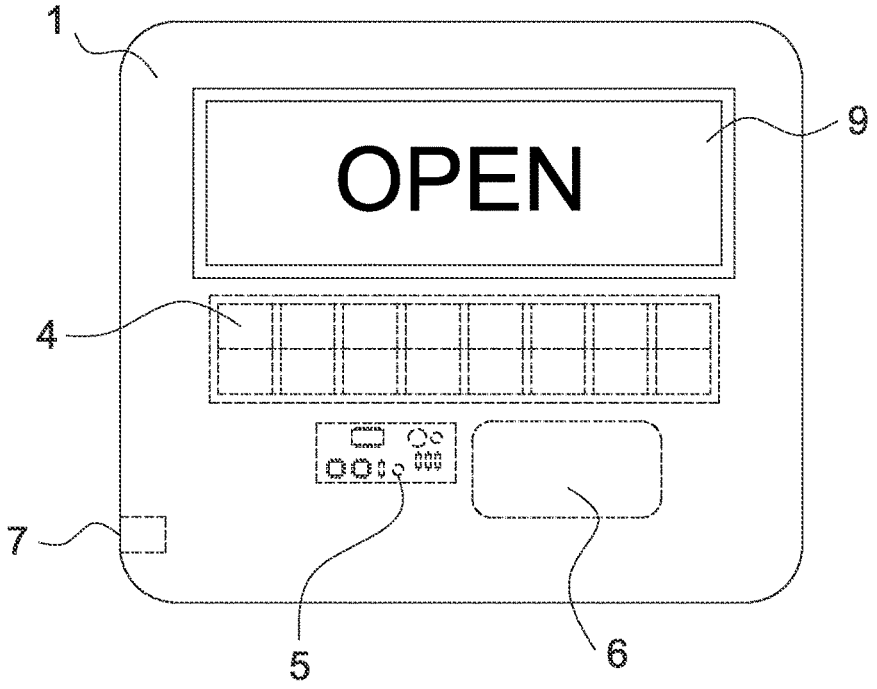
FIG. 5 is a top view of a light with a microdisplay, according to yet another example embodiment of the invention.

FIG. 5 is a top view of a light with a micro display. Rubber body 1 encapsulates solar cells 4, circuit board 5, battery 6, port 7, and a micro display 9.

Figure 6:
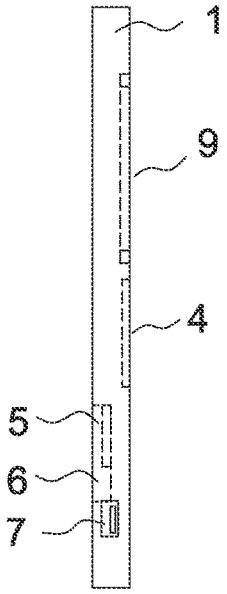
FIG. 6 is a side view of the light with the microdisplay of FIG. 5.

FIG. 6 is a side view of a light with a micro display. Rubber body 1 encapsulates solar cells 4, circuit board 5, battery 6, port 7, and a micro display 9.

In another example embodiment shown in FIGS. 5 and 6, the illuminated element can be a micro display 9. In this example embodiment, the micro display 9 can display alpha numeric signage such as "Open" or "Closed" or hours of operation. In another example embodiment the micro display 9 can display static or moving images. In another example embodiment the port 7 can be utilized to reprogram the display.

Figure 7:
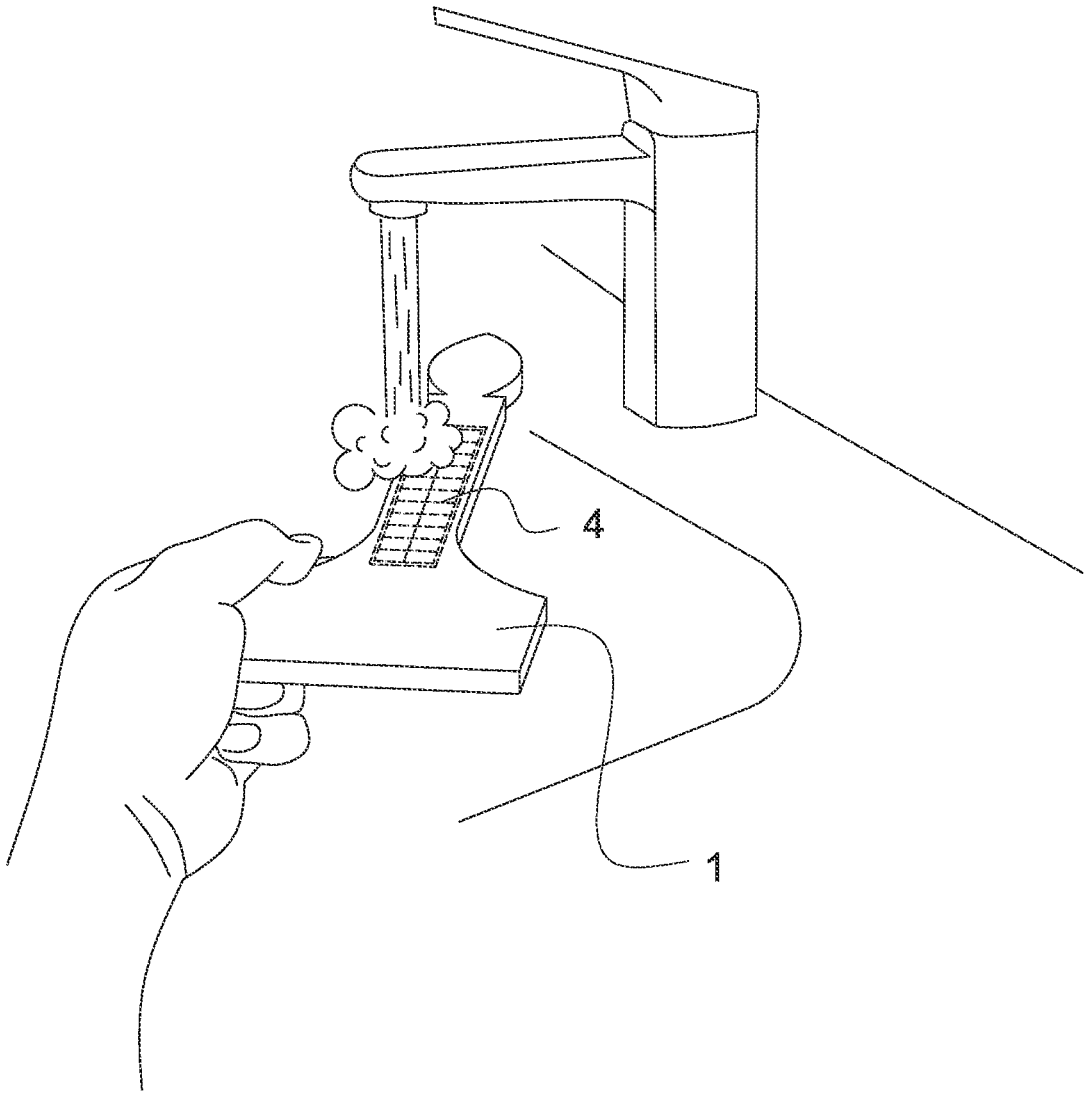
FIG. 7 is a perspective view of a light in the shape of a candlestick being rinsed off, according to still another example embodiment of the invention.

FIG. 7 is a light being rinsed off to make the rubber surface of body 1 clean and therefore active to stick on glass. Solar cells 4 and other electronics are encapsulated and therefore protected from the water rinse.

Figure 8:
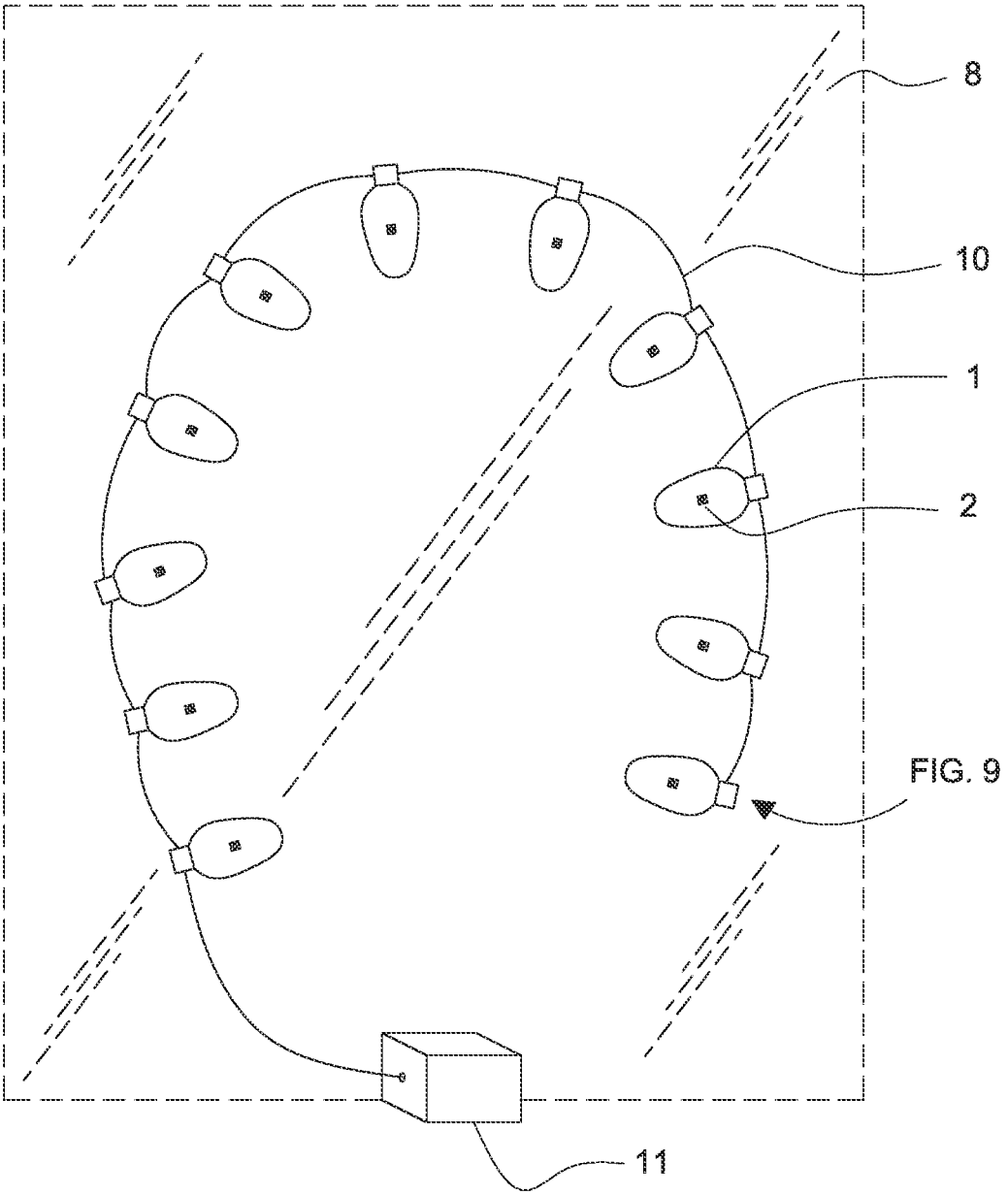
FIG. 8 is a top view of a set of individual fixtures connected in series, according to yet another example embodiment of the invention.

FIG. 8 is a set of individual rubber body 1 fixtures connected in series, each with an encapsulated LED 2, and external connecting wires 10. This is all powered and controlled with a power controller 11. The individual rubber bodies 1 are electrostatically attached to glass 8.

Figure 9:
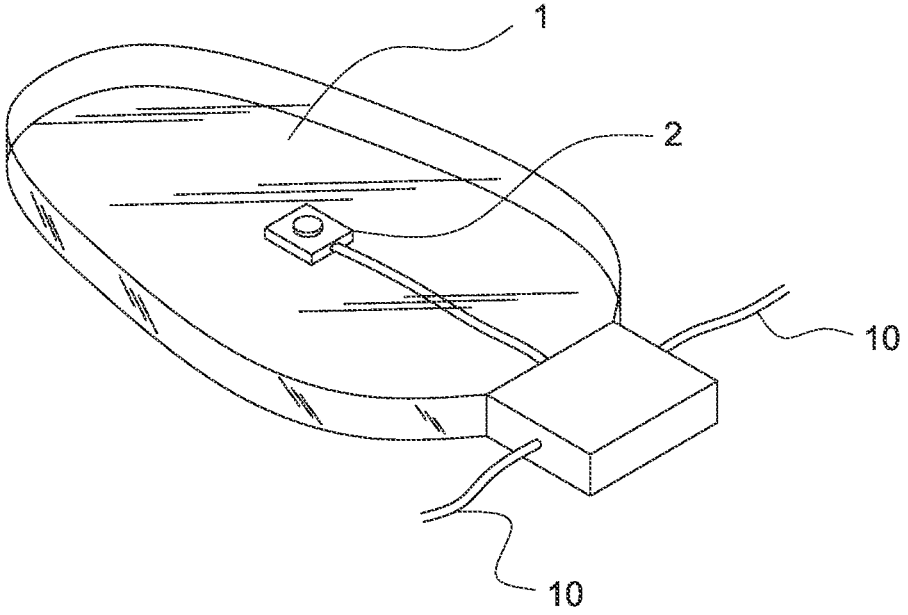
FIG. 9 is a perspective view of an individual bulb-shaped light, according to still another example embodiment of the invention.

FIG. 9 is a perspective view of one light with rubber body 1, LED 2, and external connecting wire 10.

Figure 10:
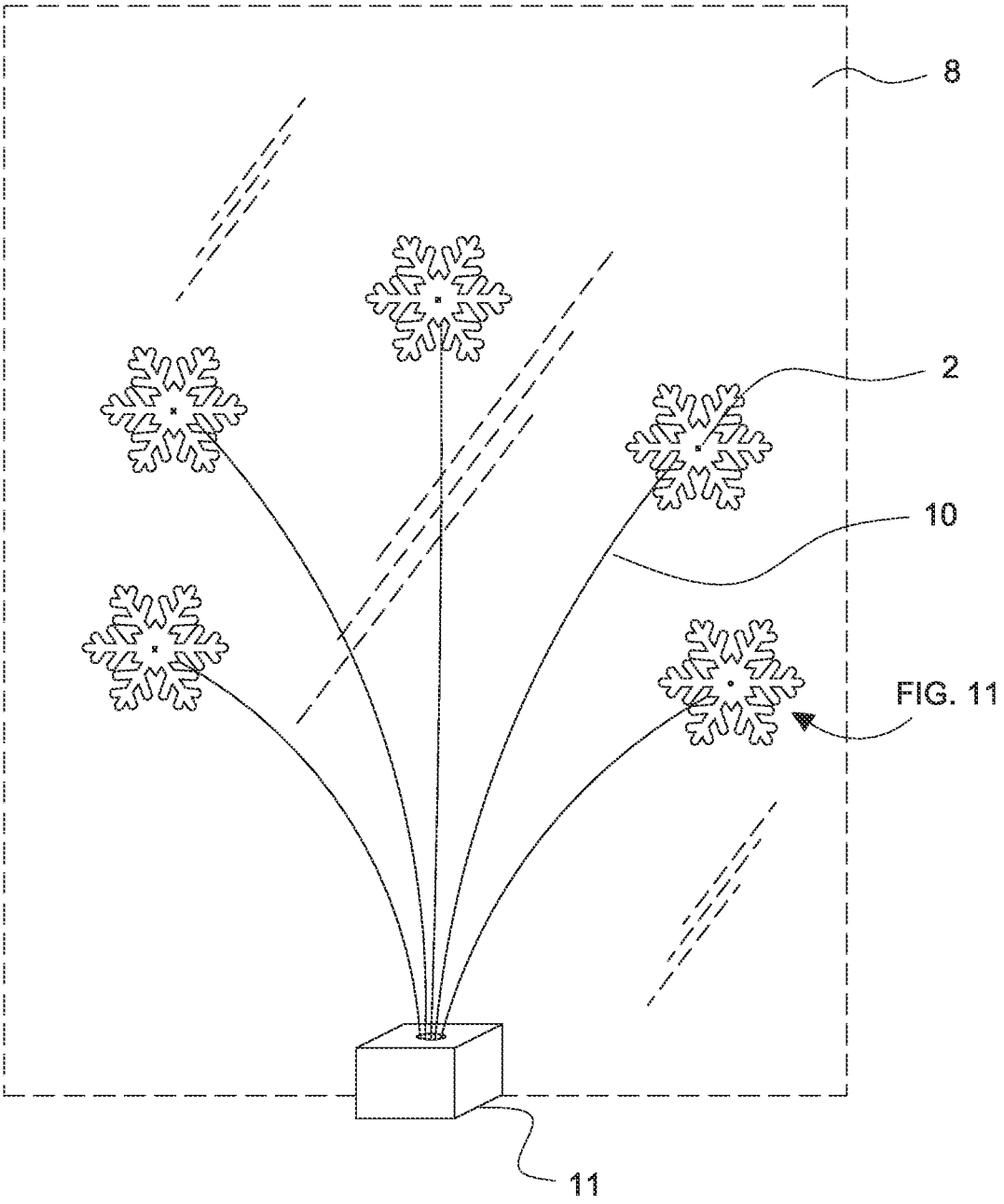
FIG. 10 is a perspective view of a set of individual lights connected in parallel, according to yet another example embodiment of the invention.

FIG. 10 is a set of individual lights connected in parallel, each with an encapsulated LED 2 light source and external connecting wires 10. These are all powered and controlled by power controller 11, and electrostatically attached to glass 8.

Figure 11:
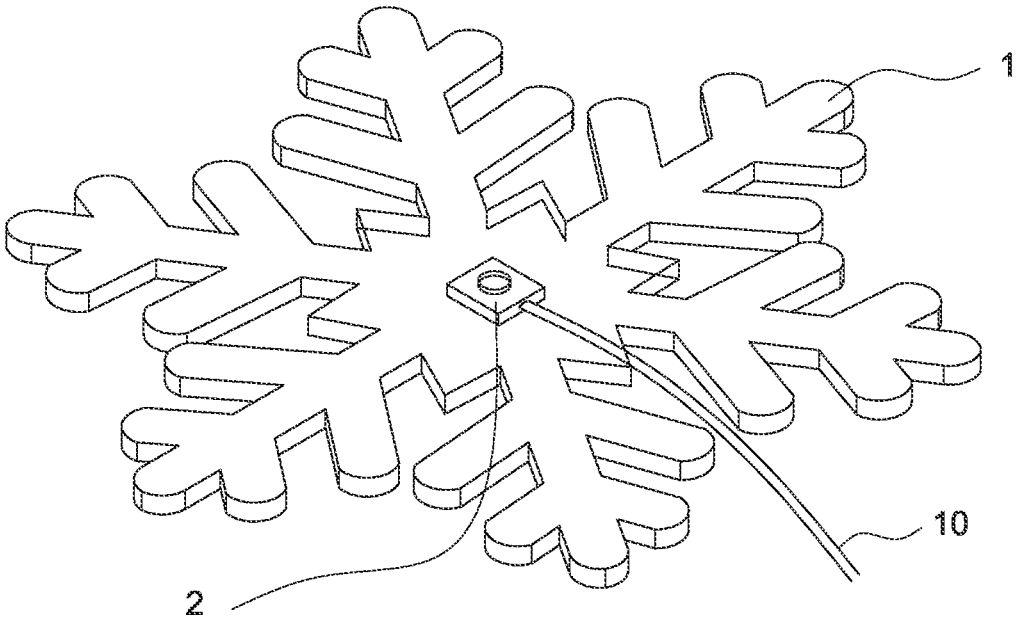
FIG. 11 is a perspective view of an individual snowflake-shaped light, according to still another example embodiment of the invention.

FIG. 11 is a perspective view of one light with encapsulating rubber body 1, LED 2 and external connecting wires 10.

Figure 12:
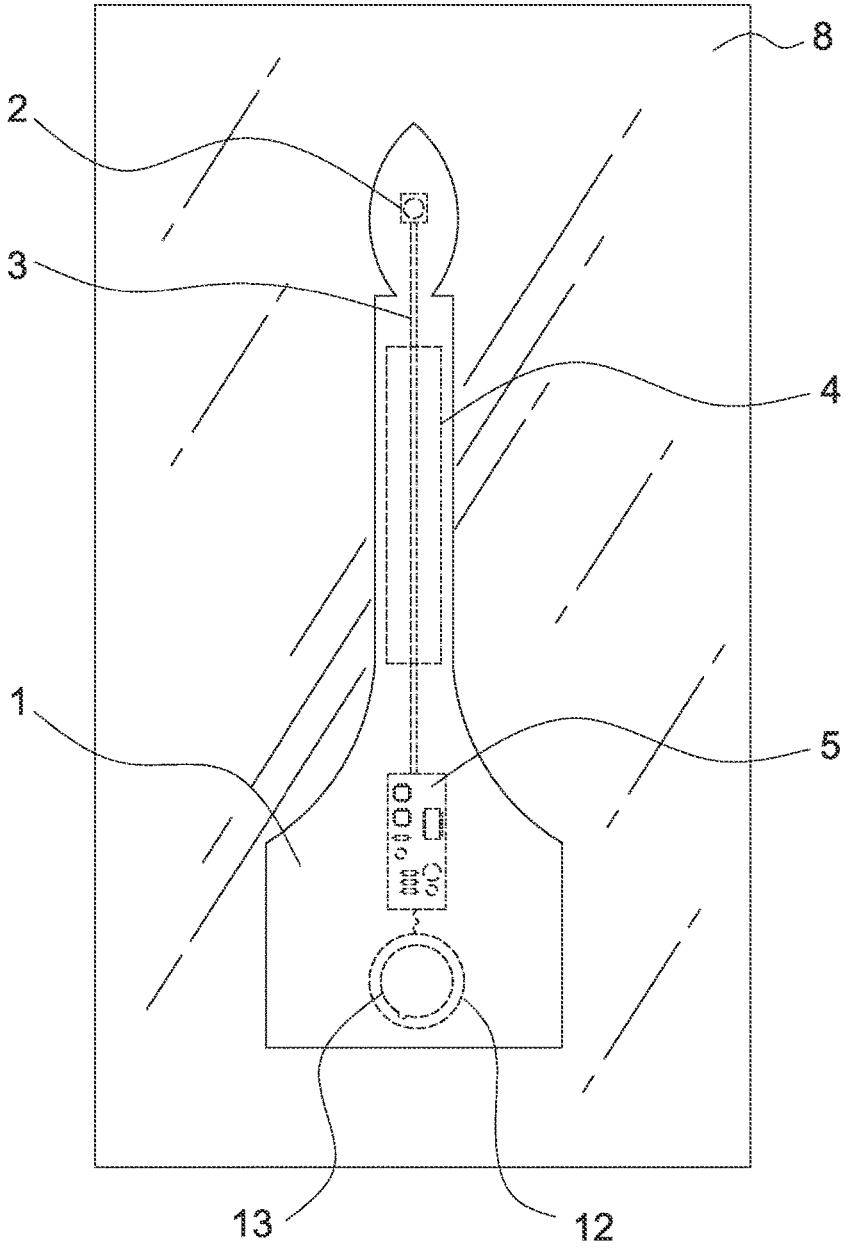
FIG. 12 is a top view of another light in the shape of a candlestick, according to a yet another example embodiment of the invention.

FIG. 12 is a top view of a light in the shape of a candlestick. The light has a full rubber encapsulating body 1, LED light 2, internal connecting wires 3, circuit board 5, battery compartment 12, removable compartment door 13, and solar cells 4. The encapsulating body 1 is sticking to glass 8.

Figure 13:
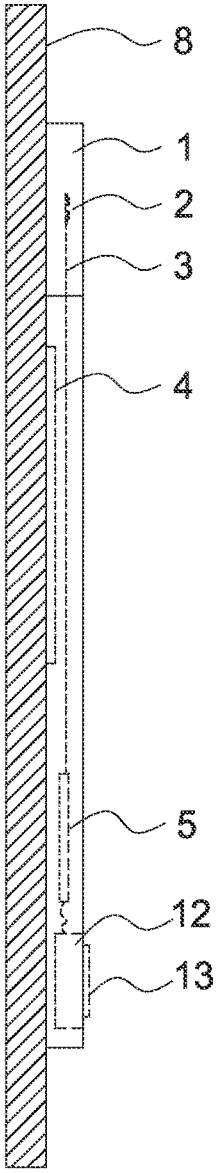
FIG. 13 is a side view of the light in the shape of the candlestick of FIG. 12.

FIG. 13 is a side view of a light in the shape of a candlestick. The rubber body 1 is sticking on glass 8 with electrostatic or Van der Waals forces. Inside the body 1 is an LED light 2, internal connecting wires 3, circuit board 5, battery compartment 12, removable compartment door 13, and solar cells 4. Solar cells 4 are facing toward the window to collect solar energy from the outside. Circuit board 5 works together with solar cells 4 to collect electricity and store it. Wires 3 connect all the devices.

In one example embodiment shown in FIGS. 12 and 13, a battery is stored in battery compartment 12. In this example embodiment, a battery is removable and replaceable through battery compartment door 13.

In another example embodiment, the light fixture includes a port that allows external charging of the battery.

In one example embodiment, the silicone encapsulation is flat on both sides allowing the light to stick on glass on either side. In this example embodiment the light can also stick to the exterior of a glass window and still have the solar cells facing outside for best light collection. In this example embodiment both sides of the light fixture are flat, so the back side could be stuck to a surface such as a garage window to show house numbers in winter months with less daylight, or back side stuck to a car window to indicate a delivery car.

In another example embodiment, the lighted element is a micro display in the shape of a candle flame. In this example embodiment the micro display image can show the image of a moving burning candle flame.

In another example embodiment a solar cell or solar cells can collect light from both sides of the light fixture.

In one example embodiment the body is silicone which fully encapsulates all the components and electronic elements to make the entire light fixture rugged so that internal wiring and components are not harmed by handling, dropping, rinsing under water, or storage for years.

In another example embodiment the light is fully encapsulated so that it can be used outside and not be affected by weather.

In one example embodiment the light is connected to and powered by connecting wires (see e.g., FIGS. 8 and 9). In this example embodiment one or more lights can be placed on a window in any location and connected to a power source. In this example embodiment the power source can power one or more lights that are placed anywhere on the window. In this example embodiment the cost of each light is reduced since the solar cell or cells, battery, and circuit board are not included in each light fixture. In another example embodiment the power source can facilitate and control a preprogrammed lighting sequence. In another example embodiment the power source can also facilitate and control an audible sequence.

In another example embodiment, separate lights can be connected in series to a power source. In another example embodiment separate lights can be connected in parallel to a power source.

In another example embodiment a switch is embedded in the rubber. In another example embodiment an embedded switch can control simple on off functions or advanced light colors or sequences.

In one or more example embodiments, the light body 1 may have a thickness (i.e., protruding dimension from surface of glass 8) that is between approximately ⅛" and approximately ¾", inclusive of all values in range, including endpoints (or between ⅛" and ¾", inclusive of all values in range, including endpoints). For example, in one embodiment, the light body 1 may have a thickness of ½". In another embodiment, the light body 1 may have a thickness of ⅜". In these one or more example embodiments, the optimal thickness for the light body 1 is as thin as possible, while still encapsulating all of the components (e.g., LEDs 2, solar cells 4, circuit board 5, battery 6, etc.).

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claim(s) in any manner. Rather, the scope of the invention is defined only by the claim(s) and their equivalents, and not, by the preceding description.

The invention claimed is:

1. An encapsulated stick-on window light, comprising:

at least one light emitting device configured to emit light; and an encapsulating body, the encapsulating body surrounding the at least one light emitting device such that the at least one light emitting device is totally enclosed within the encapsulating body, the encapsulating body having at least one surface that is configured to adhere to a glass surface by means of electrostatic forces and/or Van der Waals forces.

2. The encapsulated stick-on window light according to claim 1, further comprising a power source disposed in the encapsulating body, the power source configured to provide power for the at least one light emitting device.

3. The encapsulated stick-on window light according to claim 2, wherein the power source disposed in the encapsulating body comprises one or more batteries configured to provide power for the at least one light emitting device.

4. The encapsulated stick-on window light according to claim 3, wherein the one or more batteries are provided in a battery compartment within the encapsulating body, the battery compartment being provided with a removable compartment door that is accessible from outside of the encapsulating body.

5. The encapsulated stick-on window light according to claim 3, wherein the one or more batteries are not accessible from outside of the encapsulating body.

6. The encapsulated stick-on window light according to claim 3, wherein the power source disposed inside the encapsulating body further comprises one or more solar cells configured to provide power for the at least one light emitting device, an active surface of the one or more solar cells being disposed proximate to the at least one surface of the encapsulating body so that light is able to be absorbed by the active surface of the one or more solar cells.

7. The encapsulated stick-on window light according to claim 6, further comprising a control board disposed in the encapsulating body, the control board configured to control solar energy collection and storage by the one or more solar cells and the one or more batteries.

8. The encapsulated stick-on window light according to claim 7, wherein the control board is configured to charge the one or more batteries when light is available to the one or more solar cells, and then switch power to illuminate the at least one light emitting device when solar charging falls below a preset level indicating dark outside conditions.

9. The encapsulated stick-on window light according to claim 7, further comprising one or more electrical wires disposed in the encapsulating body, the one or more electrical wires electrically coupling the at least one light emitting device to the control board and/or the power source.

10. The encapsulated stick-on window light according to claim 1, further comprising a power port accessible from a side of the encapsulating body, the power port operatively coupled to the at least one light emitting device, the power port configured to accommodate an external power cord for providing power to the at least one light emitting device from an external power source that is external to the encapsulating body.

11. The encapsulated stick-on window light according to claim 1, wherein the at least one light emitting device is in a form of one or more light-emitting diodes (LEDs).

12. The encapsulated stick-on window light according to claim 1, wherein the at least one light emitting device is in a form of a microdisplay, the microdisplay configured to display alphanumeric signage, static images, and/or dynamic images.

13. The encapsulated stick-on window light according to claim 12, further comprising a data port accessible from a side of the encapsulating body, the data port operatively coupled to the microdisplay, and the data port configured to enable a programming and/or reprogramming of the microdisplay.

14. The encapsulated stick-on window light according to claim 1, wherein the encapsulating body allows the stick-on window light to be cleaned and rinsed with water without harming any electrical components of the stick-on window light.

15. The encapsulated stick-on window light according to claim 1, wherein the encapsulating body is formed from a material selected from a group consisting of: (i) silicone, (ii) a two-part room temperature vulcanization (RTV) material, (iii) compression molded rubber, (iv) pourable setting rubber, (v) thermoset rubber, and (vi) any other encapsulating material that exhibits electrostatic and/or Van der Waals attraction with glass.

* * * * *